US005492789A

United States Patent [19]

Igarashi et al.

[11] Patent Number: 5,492,789

[45] Date of Patent: Feb. 20, 1996

[54] PROCESS FOR PRODUCING MICROCAPSULES CONTAINING A DIAZONIUM SALT COMPOUND AND A PHOTOFIXATION THERMAL RECORDING MATERIAL EMPLOYING THE SAME

[75] Inventors: Akira Igarashi; Sadao Ishige, both of Shizuoka, Japan

[73] Assignee: Fuji Photo Film Co., Ltd., Kanagawa, Japan

[21] Appl. No.: 329,175

[22] Filed: Oct. 26, 1994

[30] Foreign Application Priority Data

Oct. 26, 1993 [JP] Japan ..... 5-267540

[51] Int. Cl.[6] ..... G03C 1/72; G03C 1/58

[52] U.S. Cl. ..... 430/138; 430/151; 430/157; 430/168; 430/169

[58] Field of Search ..... 430/138, 157, 430/151, 168, 169

[56] References Cited

U.S. PATENT DOCUMENTS 4,737,484 4/1988 Iwasaki et al. ..... 430/176

5,198,321 3/1993 Hosoi et al. ..... 430/138

5,304,452 4/1994 Ohno et al. .

*Primary Examiner*—John S. Y. Chu

*Attorney, Agent, or Firm*—Sughrue, Mion, Zinn, Macpeak & Seas

[57] ABSTRACT

A process for producing microcapsules containing a diazonium salt compound, and a photofixation thermal recording material employing the same. The process comprises adding an organic solvent solution containing both the diazonium salt compound and a polyfunctional isocyanate compound to an aqueous solution of a water-soluble polymer, emulsifying the organic solvent solution into the aqueous solution using an emulsifying agent, and then polymerizing the polyfunctional isocyanate compound to form microcapsule walls, said emulsifying agent comprising an alkyl glucoside represented by formula (I):

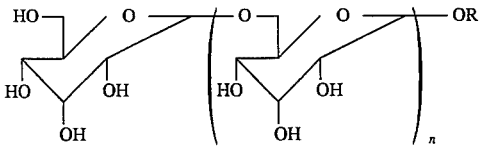

(I)

wherein n is an integer of 0 to 2 and R represents a linear or branched alkyl group having 4 to 18 carbon atoms.

6 Claims, No Drawings

PROCESS FOR PRODUCING MICROCAPSULES CONTAINING A DIAZONIUM SALT COMPOUND AND A PHOTOFIXATION THERMAL RECORDING MATERIAL EMPLOYING THE SAME

FIELD OF THE INVENTION

The present invention relates to a process for producing microcapsules containing a diazonium salt compound. More particularly, the present invention relates to a process for stably microencapsulating a diazonium salt and wherein after encapsulation the salt is stably stored in the capsules. This invention further relates to a photofixation-type thermal recording material employing the capsules.

BACKGROUND OF THE INVENTION

Diazonium salt compounds have extremely high chemical activity, and therefore react with compounds such as phenol derivatives and compounds having an active methylene group (generally called couplers) to readily form azo dyes. Since diazonium salt compounds also are light-sensitive and lose their activity by irradiation with light, they are widely utilized as photo-recording materials as described, for example, in Nippon Shashin Gakkai, "Shashin Kōgaku No Kiso—Hi-gin-en Shashin Hen—," Corona Sha (1982) pp.89– 117, pp.182–201. Due to these properties, diazonium salt compounds have also recently been applied to thermal recording materials requiring image fixation, and a thermal recording material has been proposed in which a diazonium salt compound is thermally reacted with a coupler to form an image, which is then fixed by irradiation with light (e.g., Kōji Satō et at., Gazō Denshi Gakkai-shi, Vol.11, No.4 (1982) pp.290–296). However, these recording materials employing diazonium salt compounds are disadvantageous in that the diazonium salt compounds gradually undergo pyrolysis to lose their reactivity even in the dark due to their extremely high activity. That is, such recording materials have a short shelf life.

As expedients for stably incorporating a diazonium salt into a recording material, various techniques have been proposed. Among the most effective is a technique of microencapsulating a diazonium salt compound. In this manner, the microencapsulated diazonium salt can be isolated from substances which accelerate pyrolysis, such as water or a base, resulting in a significantly improved shelf life (Tomomasa Usami et al., Denshi Shashin Gakkai-shi, Vol.26, No.2 (1987) pp.115–125).

In a process generally employed for microencapsulating a diazonium salt compound, the diazonium salt is dissolved in a hydrophobic solvent (oil phase) and the solution is added to an aqueous solution of a water-soluble polymer (aqueous phase). The mixture is then emulsified with a homogenizer or the like. This emulsification is conducted in the presence of a monomer or prepolymer which serves as a microcapsule wall material and has been added prior to mixing to one or both of the oil phase and the aqueous phase. Thus, a polymerization reaction or polymer precipitation occurs at the interface between the oil phase and the aqueous phase, to thereby form polymer walls and obtain microcapsules. Such methods are described in detail, e.g., in Asashi Kondō, "Microcapsule", Nikkan Kogyo Shinbun-sha (1970) and Tamotsu Kondō, "Microcapsule", Sankyō Shuppan (1977). For forming microcapsule walls, various materials can be used such as crosslinked gelatin, alginic acid salts, cellulose derivatives, urea resins, urethane resins, melamine resins and nylon resins. Microcapsules having capsule walls made of a resin having a glass transition temperature slightly higher than room temperature, e.g., a urea or urethane resin, are called heat-responsive wall microcapsules because the capsule walls are impermeable at room temperature but become permeable at a temperature not lower than the glass transition temperature to cause physical mixing of the diazonium compound with the coupler and basic compound arranged outside the microcapsules. This kind of microcapsule is useful in a thermal recording material. For example, heat-responsive wall microcapsules containing a diazonium salt are applied onto a substrate along with a coupler and a base to produce a recording material. As a result, the diazonium salt can be contained in the recording material in a stable manner over a prolonged time period and, in addition, easy color development by heating and image fixation by light irradiation become possible.

Although the stability of a diazonium salt compound can be greatly improved by microencapsulation as described above, some problems still remain. One problem is that the diazonium salt partly decomposes during the microencapsulation reaction. Another is that the shelf life is not always satisfactory when the recording material is stored either over a prolonged period of a few years or more or under unfavorable environmental conditions such as high-temperature and high-humidity conditions.

SUMMARY OF THE INVENTION

An object of the present invention is to provide a improved microencapsulation process for stably storing a diazonium salt compound in a recording material, which process inhibits decomposition of the diazonium salt compound during the microencapsulation reaction and imparts long shelf life.

Another object of the present invention is to provide a photofixation thermal recording material employing the microcapsules produced by the process.

Another object of the invention is to provide a process for producing microcapsules containing a diazonium salt compound and having thermally responsive polyurea/polyurethane walls, wherein decomposition of the diazonium salt compound during microencapsulation is inhibited to impart long shelf life, and to provide a photofixation-type thermal recording material employing the microcapsules produced by the process.

The present invention relates to a process for producing microcapsules containing a diazonium salt compound which comprises adding an organic solvent solution containing both the diazonium salt compound and a polyfunctional isocyanate compound to an aqueous solution of a water-soluble polymer, emulsifying the organic solvent solution into the aqueous solution using an emulsifying agent, and then polymerizing the polyfunctional isocyanate compound to form microcapsule walls, said emulsifying agent comprising an alkyl glucoside.

The term "alkyl glucoside" in this invention means a compound consisting of a saccharide as a hydrophilic group and an alkyl group as a hydrophobic group (lipophilic group) which are bonded together through a glycoside bond. This compound, which is a kind of nonionic surfactant, is represented by formula(I):

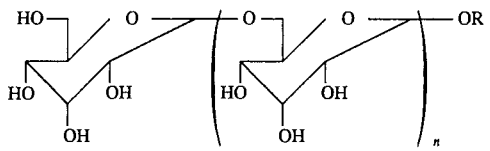

(I)

wherein n is an integer of 0 to 2 and R represents a linear or branched alkyl group having 4 to 18 carbon atoms.

DETAILED DESCRIPTION OF THE INVENTION

Examples of the alkyl group represented by R include n-butyl, isobutyl, n-hexyl, n-heptyl, n-octyl, 2-ethylhexyl, n-decyl, n-dodecyl, n-hexadecyl, n-octadecyl, and branched octadecyls. When the alkyl glucoside is produced by an industrial process, it is a mixture of a monosaccharide glucoside in which n=0, as a main component, with glucosides in which n is 1–2. However, a composition of the mixture does not influence the effect of the present invention. Furthermore, two or more alkyl glucosides of the invention having different alkyl groups can be used in combination. Although the alkyl glucoside surfactant of this invention may be used in combination with other ordinary surfactant(s), the alkyl glucoside surfactant is preferably used as the main surfactant accounting for at least 50% by weight, and further preferably 70% by weight, of all surfactants used as an emulsifying agent.

One embodiment of the process of the present invention is explained below with respect to the production of diazonium-salt-compound-containing microcapsules (polyurea/polyurethane wall). The diazonium salt is dissolved in a high-boiling hydrophobic solvent which will serve as capsule cores. It is possible to use a low-boiling solvent in combination with the high-boiling solvent. Although a low-boiling solvent alone may be used in some cases, this results in capsules which do not have distinct cores. A polyfunctional isocyanate is further added as a wall-forming agent to the core solvent (oil phase). On the other hand, an aqueous solution of a water-soluble polymer, e.g., poly(vinyl alcohol) or gelatin, is prepared as an aqueous phase, into which the oil phase is poured and emulsified with a homogenizer or other means. In this emulsification, the water-soluble polymer functions as a stabilizer for emulsification. For the purpose of conducting the emulsification in a stable manner, a surfactant is added to at least one of the oil phase and aqueous phase. The diameters of the dispersed particles are generally about from 0.2 to 10 μm. In the emulsion, the polyfunctional isocyanate undergoes a polymerization reaction at the interface between the oil phase and aqueous phase to form polyurea walls. By adding a polyol to the aqueous phase before mixing, polyurethane walls can also be formed through the reaction of the polyfunctional isocyanate with the polyol. An effective means for heightening the reaction rate is to maintain a high reaction temperature or to add a suitable polymerization catalyst. Polyfunctional isocyanates, polyols, reaction catalysts, polyamines for use as a component of wall-forming agents, and other ingredients are described in detail, for example, in Keiji Iwata, "Polyurethane Handbook," Nikkan Kogyo Shinbun-sha (1987).

The diazonium salt microencapsulated by the method described above has significantly improved stability as compared with a diazonium salt dispersed as solid particles in a water-soluble polymer. In this manner, the microencapsulated diazonium salt does not undergo pyrolysis and hydrolysis with the lapse of time. However, slight decomposition of the diazo compound is observed during storage over long periods of time or under high-temperature and high-humidity conditions. As a result, the background whiteness of a recording material employing the microencapsulated diazo compound decreases due to staining by the products of diazo decomposition. It has also been found that the diazonium salt compound during the encapsulation reaction decomposes in slight degree. This reduces the amount of the diazonium salt compound remaining after encapsulation, and also yields decomposition products which stain the background of the recording material. As a result of their investigations, the present inventors consider that the above-described decomposition of a diazo compound is brought about by the wall material of the microcapsules, and that the decomposition is mainly attributable to an amine compound formed during the wall-forming reaction remains after completion of the reaction. Furthermore, the present inventors have discovered that the stability of a diazonium salt compound during or after the encapsulation reaction depends on the kind of surfactant used for emulsification during the encapsulation.

In general, surfactants having a relatively long-chain hydrophobic group are regarded as superior for use in emulsification (Ichirō Nishi et al., "Kaimen Kassei-zai Binran," Sangyō Tosho (1960) pp.210–270), and alkali metal salts of alkylsulfonic acids, alkylbenzenesulfonic acids, or the like are used. However, the present inventors have ascertained that diazonium salt-containing microcapsules prepared using such typical emulsifying surfactants as emulsifying agents are not always ideal for stably storing the diazonium salt and that such surfactants tend to decompose the diazonium salt, during or after the encapsulation reaction. The present inventors thereafter studied a wider range of surfactants. As a result, they have found that an alkyl glucoside is an exceedingly superior surfactant for attaining the objects of the invention. The present invention has been completed based on this finding.

The kind of diazonium salt compound for use in the present invention is not particularly limited, and diazonium salt compounds generally used in the art are suitable. The diazonium salt compound is a compound represented by formula (II):

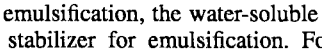

$$Ar—N_2^+X^- \quad (II)$$

wherein Ar represents an aromatic moiety and $X^-$ represents an acid anion. This compound reacts with a phenol compound or a compound having an active methylene group to form an azo dye. Furthermore, it decomposes with loss of nitrogen upon irradiation with light (generally ultraviolet) and, as a result, it loses its activity. Examples of the diazonium salt for use in the present invention include salts of 2,5-dibutoxy-4-morpholinobenzenediazonium, 2,5-octoxy-4-morpholinobenzenediazonium, 2,5-dibutoxy-4-(N-(2-ethylhexanoyl)piperazino)benzenediazonium, 2,5-diethoxy-4-(N-(2-(2,4-di-tertaminophenoxy)butyryl)piperazino)benzenediazonium, 2,5-dibutoxy-4-tolylthiobenzenediazonium, 2,5-dibutoxy-4-chlorobenzenethiodiazonium, 3-(2-octyloxyethoxy)-4-morpholinobenzenediazonium, 4-N,N-dihexylamino-2-hexyloxybenzenediazonium, and 4-N-hexyl-N-tolylamino-2-hexyloxybenzenediazonium. For microencapsulation, the diazonium salt compound preferably is oil-soluble, and salts in the form of hexafluorophosphate, tetrafluoroborate, and 1,5-naphthalenesulfonate are particularly useful.

The hydrophobic solvent used for dissolving the diazonium salt compound therein to form microcapsule cores is preferably a high-boiling organic solvent having a boiling point of from 100° to 300° C. Examples thereof include alkylnaphthalenes, alkyldiphenylethanes, alkyldiphenylmethanes, alkylbiphenyls, chlorinated paraffins, tricresyl phosphate, maleic esters, and adipic esters. A mixture of two or more of these may be used. The amount of the diazonium salt compound is generally 5 to 30% by weight based on the total amount of the organic solvet solution. When the diazonium salt compound to be encapsulated has poor solubility in these solvents, it is possible to use such high-boiling solvents in combination with a low-boiling solvent generally having a boiling point of not more than 100° C. in which the diazonium salt has good solubility. Examples of the low-boiling solvent include ethyl acetate, butyl acetate, methylene chloride, tetrahydrofuran and acetone. The amount of the low-boiling solvent is generally from 30 to 200% by weight based on the amount of the high-boiling solvent. If one or more low-boiling solvents alone are used for forming capsule cores, the solvents volatilize out during the encapsulation reaction to give so-called coreless capsules in which the diazo compound has been united with the capsule walls.

The polyfunctional isocyanate compound for use as a material for microcapsule walls preferably includes a compound having a tri- or more functional isocyanate group, which may be used in combination with a bifunctional isocyanate compound. Examples thereof include dimers or trimers (biurets or isocyanurates) produced mainly from diisocyanates such as xylene diisocyanate and its hydrogenation product, hexamethylene diisocyanate, tolylene diisocyanate and its hydrogenation product, and isophorone diisocyanate. Examples thereof further include polyfunctional adducts of these diisocyanates with polyols such as trimethylolpropane and condensates of benzene isocyanate with formalin. The amount of the polyfunctional isocyanate compound in the organic solvent solution is generally 5 to 30% by weight based on the total amount of the organic solvent and the diazonium salt compound.

A polyol or polyamine may be added to the hydrophobic solvent solution serving as a core material or to the water-soluble polymer solution serving as a dispersion medium prior to emulsifying, so that the polyol or polyamine becomes a component of the microcapsule walls. Examples of the polyol or polyamine include propylene glycol, glycerol, trimethylolpropane, triethanolamine, sorbitol, and hexamethylenediamine. In the case of adding a polyol, polyurethane walls are formed.

The oil phase (organic solvent solution) thus prepared for forming capsules is dispersed into an aqueous solution of a water-soluble polymer. The water-soluble polymer is preferably one having a solubility in water of 5 or higher at the temperature at which emulsification is performed. The amount of the water-soluble polymer to be added to water is generally from 2 to 10% by weight based on the amount of the water. Examples thereof include poly(vinyl alcohol) and modification products thereof, polyacrylamide and derivatives thereof, ethylene-vinyl acetate copolymers, styrene-maleic anhydride copolymers, ethylene-maleic anhydride copolymers, isobutylene-maleic anhydride copolymers, polyvinylpyrrolidone, ethylene-acrylic acid copolymers, vinyl acetate-acrylic acid copolymers, carboxymethyl cellulose, methyl cellulose, casein, gelatin, starch derivatives, gum arabic, and sodium alginate. These water-soluble polymers preferably has little or no reactivity with isocyanate compounds. Consequently, when a polymer having reactive amino groups in the molecular chain, e.g., gelatin, is used, the polymer is preferably modified by, e.g., treatment with a phthalic acid, to reduce its reactivity prior to use. The amount ratio of the oil phase to the water phase by weight is generally from 1/3 to 3/1.

For emulsification of the oil phase into the aqueous phase in the process of this invention, an alkyl glucoside is used as an emulsifying agent. Compared to ordinary surfactants for emulsification, the alkyl glucoside has a larger hydrophilic group and, hence, far higher water solubility. Therefore, the alkyl glucoside is generally added to the aqueous phase, and the amount thereof is preferably 0.1 to 5% by weight, especially 0.5 to 2% by weight, based on the amount of the oil phase. For emulsification, a known emulsifying device may be used such as, e.g., a homogenizer, ultrasonic dispersing machine, or Kady mill. After emulsification, the emulsion is heated to a temperature of from 30° to 70° C. to accelerate the reaction for capsule wall formation. To prevent the aggregation of capsules during the reaction, water is preferably further added further to reduce the probability of collision between capsules or sufficient stirring should be conducted. Furthermore, a dispersant may also be added during the reaction to prevent aggregation. The generation of carbon dioxide gas is observed with progress of the polymerization reaction, and the termination thereof can be regarded as the termination of the capsule wall-forming reaction. Usually, the desired microcapsules containing the diazonium salt compound can be obtained by conducting the reaction for several hours.

An example of application of the diazonium salt compound-containing microcapsules obtained by the process of the present invention and having improved diazonium salt compound stability for preparing a fixation-type thermal recording paper is described below.

A diazonium salt compound is encapsulated by the method described above. A coupler which reacts with the diazonium salt compound to form a dye is prepared in a finely dispersed state by converting it into an emulsion or suspension. Examples of the coupler include resorcinol, phloroglucinol, sodium 2,3-dihydroxynaphthalene-6-sulfonate, 1-hydroxy-2-naphthoic morpholinopropylamide, 1,5-dihydroxynaphthalene, 2,3-dihydroxynaphthalene, 2,3-dihydroxy-6-sulfanilnaphthalene, 2-hydroxy-3-naphthanilide, 2-hydroxy-3-naphthoic ethanolamide, 2-hydroxy-3-naphthoic octylamide, 2-hydroxy-3-naphthoic N-dodecyloxypropylamide, 2-hydroxy-3-naphthoic tetradecylamide, acetanilide, acetoacetanilide, benzoylacetanilide, 2-chloro-5-octylacetoacetanilide, 1-phenyl-3-methyl-5-pyrazolone, 1-(2'-octylphenyl)-3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamido-5-pyrazolone, 1-(2-dodecyloxyphenyl)-2-(methyl carbonato)cyclohexane- 3,5-dione, 1-(2-dodecyloxyphenyl)cyclohexane-3,5-dione, N-phenyl-N-dodecylbarbituric acid and N-Phenyl-N-(3-stearyloxy)butylbarbituric acid. Two or more of these couplers may be used in combination to develop a desired hue.

In general, a basic compound is further added in order to accelerate the dye-forming reaction. In addition to an inorganic or organic base, the basic compound may be a compound which undergoes decomposition upon heating or other changes to release an alkali. Representative examples thereof include nitrogen compounds such as organic ammonium salts, organic amines, amides, urea and thiourea and derivatives thereof, thiazole compounds, pyrrole compounds, pyrimidine compounds, piperazine compounds, guanidine compounds, indole compounds, imidazole compounds, imidazoline compounds, triazole compounds, morpholine compounds, piperidine compounds, amidine compounds, formamidine compounds and pyridine compounds. Specific examples of such compounds include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl- 2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole and 2-benzoylhydrazinobenzothiazole. Two or more of these may be used in combination.

To emulsify a coupler and a basic substance, these compounds are dissolved in a small amount of a high-boiling organic solvent, and the solution is emulsified with a homogenizer or the like in a 2 to 10 wt % aqueous solution of a water-soluble polymer. A low-boiling solvent may be used as needed as a dissolution aid. For this emulsification, a surfactant is preferably used in the amount of 0.5 to 2.0% by weight based on the total amount of the oil phase in order to accelerate particle size reduction. Surfactants useful for this purpose include, in addition to the alkyl glucoside of this invention, known emulsifying surfactants disclosed, e.g., in the references cited above. Surprisingly, it has been found that the particular type of surfactant used at this stage substantially does not affect the shelf life of the diazonium salt compound even after the emulsion is mixed with a dispersion of the diazonium salt-containing microcapsules of the present invention or after the resulting mixture is applied to produce a thermal recording material. The high-boiling organic solvent, low-boiling organic solvent, water-soluble polymer, etc. may be selected from the materials described above.

In preparing a suspension of a coupler and a basic substance, crystals of the coupler and the basic substance are added to an aqueous solution containing a small amount of a water-soluble polymer and finely dispersed therein using a dispersing means such as a ball mill.

The liquids thus prepared are mixed in adequate proportion and applied onto a substrate. In general, the range of the coupler amount is from 1 to 10 mol, preferably from 2 to 6 mol, per mol of the diazonium salt compound. The optimal range of the addition amount of the basic compound varies depending on its basicity, but is generally from 0.5 to 5 mol per mol of the diazonium salt compound.

The heat-sensitive coating liquid comprising the above-described ingredients is then applied, to a substrate conventionally used in this art. Examples thereof include paper, coated papers produced by coating paper with clay or the like, laminated papers produced by laminating polyethylene, polyesters, or the like to paper, synthetic papers, and plastic bases made of poly(ethylene terephthalate), polyimides, triacetyl cellulose, etc.

As needed, a protective layer may be further formed on the thermal recording layer by coating. Thus, a fixation-type thermal recording paper is obtained.

By heating the recording side of the completed fixation-type thermal recording paper with a thermal head or the like, the capsule walls made of a polyurea or polyurethane are softened. As a result, the coupler and basic compound present outside the capsules penetrate into the capsules to develop a color. After color development, the resulting recording paper is irradiated with light having a wavelength which is an absorption wavelength of the diazonium salt compound. Consequently, the diazonium salt compound is decomposed and loses its reactivity with the coupler to thereby fix the image.

Examples of the present invention are given below, but the invention should not be construed as being limited thereto. In the Examples, all parts are by weight.

(1) Preparation of Dispersions of Microcapsules Containing Diazonium Salt Compound

EXAMPLE 1

In 20 parts of ethyl acetate was dissolved 4 parts of 4-chlorophenylthio-2,5-dibutoxybenzenediazonium hexafluorophosphate as a diazonium salt compound. Thereto was added 20 parts of isopropyldiphenylethane as a high-boiling solvent. The resulting mixture was heated to give a homogeneous solution, which was then cooled to room temperature. To this solution was added 8 parts of a xylylene diisocyanate/trimethylolpropane adduct (75% ethyl acetate solution) as an agent for forming capsule walls. This mixture was stirred to prepare a homogeneous oil phase serving as capsule cores. On the other hand, 1.2 parts of a 50 wt % aqueous solution of n-octyl glucoside (a mixture having a monosaccharide glucoside content of 60%) as a surfactant for emulsification was added to and dissolved in 50 parts of a 6 wt % aqueous solution of phthalated gelatin to provide a homogeneous solution. To this aqueous phase was added the oil phase prepared above. The resulting mixture was treated with a homogenizer (Type AM, manufactured by Nippon Seiki K.K., Japan) to emulsify the oil phase, thereby providing an emulsion having an average particle diameter of 1 μm. To the emulsion thus obtained was added 60 parts of warm water. The resulting emulsion was then heated to 40° C. and allowed to undergo encapsulation reaction for 3 hours with gentle stirring. As the reaction proceeded, generation of bubbles due to decarbonation was observed.

EXAMPLE 2

The same procedure as in Example 1 was conducted, except that 2-ethylhexyl glucoside (a mixture having a monosaccharide glucoside content of 70%) was added as a surfactant for emulsification.

EXAMPLE 3

The same procedure as in Example 1 was conducted, except that n-butyl glucoside (a mixture having a monosaccharide glucoside content of 60%) was added as a surfactant for emulsification.

EXAMPLE 4

The same procedure as in Example 1 was conducted, except that n-dodecyl glucoside (a mixture having a monosaccharide glucoside content of 70%) was added as a surfactant for emulsification.

COMPARATIVE EXAMPLE 1

The same procedure as in Example 1 was conducted, except that sodium dodecylbenzenesulfonate was used as a surfactant for emulsification.

(2) Preparation of Samples for Stability Evaluation

Each of the microcapsule dispersions prepared in the Examples and Comparative Example was applied to a poly(ethylene terephthalate) substrate in an amount of 1 to 1.1 g/m$^2$ in terms of the calculated amount of diazonium salt, and then dried. Thus, coated samples (A) were prepared.

On the other hand, 2 parts of 4-chloro-2,5-dibutoxypivaloylacetanilide as a coupler, 2 parts of 1,2,3-triphenylguanidine as a basic compound, and 0.3 part of tricresyl phosphate and 0.1 part of diethyl maleate as high-boiling organic solvents were dissolved in 10 parts of ethyl acetate to provide a homogeneous solution. This solution was added to an aqueous solution prepared by mixing 50 parts of 6% aqueous gelatin solution and 2 parts of 2% sodium dodecylbenzenesulfonate solution, and the resulting mixture was treated with a homogenizer for 10 minutes to provide an emulsion. The emulsion was then stirred at about 40° C. for 3 hours to volatilize the ethyl acetate. This emulsion was mixed with each of the microcapsule dispersions prepared in the Examples and Comparative Examples described above, in such proportion that the diazonium salt compound/coupler ratio was 2/5. Each mixture was applied to a poly(ethylene terephthalate) substrate in an amount of 0.5 g/m$^2$ in terms of the amount of the diazonium salt compound, and then dried. Thus, samples (B) were prepared.

(3) Evaluation of the Stability of Diazonium Salt Compound during Encapsulation

A test piece having dimensions of 5 cm by 5 cm was cut from each of samples (A). Each test piece was immersed with stirring for an entire day and night in a methanol aqueous solution acidified with hydrochloric acid to extract the diazonium salt compound. The extract was analyzed by high speed liquid chromatography (column: YMC-A-311, manufactured by Waters Inc.; developing solvent: acetonitrile/water mixed solvent) to determine the amount of the diazonium salt compound deposited on the sample. The proportion of this amount to the theoretical deposition amount calculated from the formulation used for encapsulation is shown in Table 1.

(4) Evaluation of the Stability of Encapsulated Diazonium Salt Compound

The amount of the diazonium salt compound contained in each of the samples (A) and (B) was determined by the method described above. Subsequently, each sample was stored for 72 hours in a thermo-hygrostatic chamber regulated at a temperature of 40° C. and a humidity of 80% RH, and then similarly analyzed to determine the amount of residual diazonium salt compound. Thus, the proportion of the diazonium salt compound amount following treatment to the amount before treatment was determined. Furthermore, samples (A) and (B) before treatment and after treatment were sufficiently irradiated with fluorescent lamp light having a wavelength of 420 nm to fix images. The density of the background of each sample was then measured with a reflective densitometer (RD-918; equipped with a blue filter) manufactured by Macbeth Inc. to determine the extent of staining of the background due to diazo decomposition products.

The results obtained are summarized in Table 1.

TABLE 1

| Sample | Surfactant for emulsification | Amount of diazonium salt remaining after encapsulation | Background density before treatment* (A) | Background density before treatment* (B) | Background density after treatment* (A) | Background density after treatment* (B) | Residual diazonium salt amount after treatment* (A) | Residual diazonium salt amount after treatment* (B) |
|---|---|---|---|---|---|---|---|---|
| Example 1 | n-octyl glucoside | 98% | 0.14 | 0.12 | 0.16 | 0.14 | 95% | 92% |
| Example 2 | 2-ethylhexyl glucoside | 98% | 0.14 | 0.12 | 0.17 | 0.15 | 94% | 93% |
| Example 3 | n-butyl glucoside | 97% | 0.15 | 0.13 | 0.18 | 0.16 | 93% | 92% |
| Example 4 | n-dodecyl glucoside | 98% | 0.13 | 0.12 | 0.16 | 0.14 | 95% | 93% |
| Compara. Ex. 1 | sodium dodecylbenzensulfonate | 93% | 0.20 | 0.16 | 0.35 | 0.26 | 75% | 63% |

*treatment: 72-hour storage at 40° C., 80% RH

As clearly shown by Table 1, the diazonium salt compound contained in the microcapsules produced by the process of this invention decomposed to only a small extent during the encapsulation, and was exceedingly stable after encapsulation.

Accordingly, by following the process of the present invention, stable microcapsules containing a diazonium salt are produced.

While the invention has been described in detail and with reference to specific embodiments thereof, it will be apparent to one skilled in the art that various changes and modifications can be made therein without departing from the spirit and scope thereof.

What is claimed is:

1. A process for producing microcapsules containing a photosensitive diazonium salt compound which comprises adding an organic solvent solution containing both the diazonium salt compound and a polyfunctional isocyanate compound to an aqueous solution of a water-soluble polymer, emulsifying the organic solvent solution into the aqueous solution using an emulsifying agent, and then polymerizing the polyfunctional isocyanate compound to form microcapsule walls, said emulsifying agent comprising an alkyl glucoside represented by formula (I):

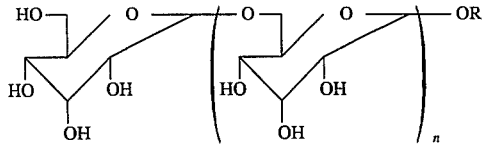

(I)

wherein n is an integer of 0 to 2 and R represents a linear or branched alkyl group having 4 to 18 carbon atoms.

2. A photofixation thermal recording material comprising a support having thereon a recording layer comprising, in admixture, microcapsules containing a diazonium salt compound, a coupler which reacts with the diazonium salt compound to form a dye, and a basic compound, wherein the coupler and the basic compound are arranged outside the microcapsules, and wherein the microcapsules are prepared by a process comprising the step of adding an organic solvent solution containing both the diazonium salt compound and a polyfunctional isocyanate compound to an aqueous solution of a water-soluble polymer, emulsifying the organic solvent solution into the aqueous solution using an emulsifying agent, and then polymerizing the polyfunctional isocyanate compound to form microcapsule walls, said emulsifying agent comprising an alkyl glucoside represented by formula (I):

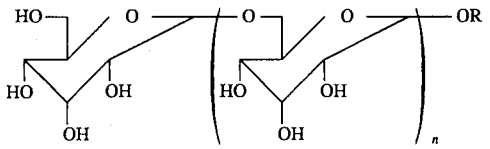

(I)

wherein n is an integer of 0 to 2 and R represents a linear or branched alkyl group having 4 to 18 carbon atoms.

3. The process of claim 1, wherein the alkyl glucoside accounts for at least 50% by weight of all surfactants used as an emulsifying agent.

4. The process of claim 1, wherein the polyfunctional isocyanate compound has a tri- or more functional isocyanate group.

5. The process of claim 1, wherein the alkyl glucoside is added to the aqueous solution of the water-soluble polymer prior to emulsifying.

6. The process of claim 1, wherein the addition amount of alkyl glucoside is from 0.1 to 5% by weight based on the amount of the organic solvent solution.

* * * * *